US007181930B2

(12) United States Patent
Wainberg

(10) Patent No.: US 7,181,930 B2
(45) Date of Patent: Feb. 27, 2007

(54) MULTIPLE CONFIGURATION RING

(76) Inventor: Yasco Wainberg, 307 W. 38th St., Suite 208, New York, NY (US) 10017

( * ) Notice: Subject to any disclaimer, the term of this patent is extended or adjusted under 35 U.S.C. 154(b) by 51 days.

(21) Appl. No.: 10/615,735

(22) Filed: Jul. 8, 2003

(65) Prior Publication Data

US 2005/0005638 A1 Jan. 13, 2005

(51) Int. Cl.
*A44C 9/00* (2006.01)

(52) U.S. Cl. ..... 63/15; 63/15.1

(58) Field of Classification Search ..... 63/1.16, 63/3, 15.1, 15.2, 15.3, 15.4, 15, 15.7; D11/26
See application file for complete search history.

(56) References Cited

U.S. PATENT DOCUMENTS 1,422,819 A * 7/1922 Blaicher ..... 63/15
1,712,417 A * 5/1929 Beaujard, Jr. ..... 63/15.3
1,778,726 A * 10/1930 Pappert ..... 63/3
1,936,604 A * 11/1933 Moldenhauer ..... 63/15
1,999,974 A * 4/1935 Heyman ..... 63/15.4
2,128,644 A * 8/1938 Gittler ..... 63/15
2,182,876 A 12/1939 Moldenhauer
D136,037 S 7/1943 Lampl
3,321,934 A 5/1967 Boyd
D266,062 S 9/1982 Austin
D292,682 S * 11/1987 Bulgari ..... D11/27
D293,898 S * 1/1988 Bulgari ..... D11/27
5,228,316 A * 7/1993 Meyrowitz ..... 63/15.4
5,483,808 A * 1/1996 Barbazza ..... 63/15.5
5,916,271 A * 6/1999 Baum ..... 63/15
D442,509 S 5/2001 Yamanaka
6,295,732 B1 * 10/2001 Ofiesh, II ..... 29/896.412
6,526,779 B2 * 3/2003 Foote ..... 63/15

* cited by examiner

*Primary Examiner*—Jack W. Lavinder
(74) *Attorney, Agent, or Firm*—Stephen E. Feldman PC

(57) ABSTRACT a ring arrangement having at least two ring portions, the ring portions including a first inner ring portion and a second outer ring portion, the inner portions having an ornamental area at least partially defined by the through holes and at the outer ring portion defining a solid band. The surface of which shows the through holes defined in the inner ring portion to give the effect of a deeply engraved surface.

13 Claims, 2 Drawing Sheets

MULTIPLE CONFIGURATION RING

BACKGROUND

1. Technical Field

The present disclosure relates to rings. More particularly, the present disclosure relates to the molding of ring components that can define different ring configurations.

2. Background of Related Art

Rings are commonly made of precious metals using the lost wax method. The lost wax method makes a plaster cast around an intricately carved wax model. The was is then melted and the plaster cast is filled with molten metal. When the metal cools sufficiently the plaster is washed away revealing a metal replication of the wax model. The metal is finished and then used to create a master rubber mold from which future wax models are fabricated. The making of the wax model and finishing of the initial metal model are skillful and time consuming tasks which encourage novel ornamental designs unique for each rubber master mold.

A design for a ring is described in U.S. Design Pat. No. 136,037 to Lampl. The ring is shown having an ornamental design on the outer surface and the reverse image of the ornamental design on the inner surface. The ornamental designs on the ring are at least partially defined by through holes outlining the perimeters of the ornamental designs. Thus, Lampl is limited in its ability to be flexibly molded in a variety of combinations of ring designs using more than one mold.

In U.S. Design Pat. No. 266,062 to Austin, an ornamental ring design for a band is shown. The band is a single annular piece having a first writing on an inner surface of the band and a second writing on an outer surface of the band. Ornamental designs are also defined on the edges of the band. Austin, however, is a single band and lacks the flexibility to vary the design through the use of separate wax models for different portions of the ring.

A design for a ring is described in U.S. Pat. No. 442,509 to Yamanaka having a simple annular band with cut-out portions positioned on the inner side of the band. Insets of material different from that of the ring are positioned in the cut-out and could include a diamond, for example, or a geometric pattern. Thus, Yamanaka describes a simple single piece ring with the inside of the band having an inset of different material than the ring material. This configuration still lacks the flexibility, however, to vary the outer configuration of the different portions of the ring by varying the molding process.

A ring having an articulated portion is described in U.S. Pat. No. 2,182,876 to Moldenhauer. The articulated portion provides a concealed and protected surface suitable for inscribing a legend. The articulated portion can be part of the mounting for the gems or a portion of the band. Moldenhauer, however, is limited to providing a series of unique embodiments having articulated portions and does not accommodate a flexible mold configuration for adaptively combining or separating wax models to produce a variety of ornamental designs associated with the articulated ring embodiments.

Referring to U.S. Pat. No. 3,321,934 to Boyd, a ring configured for carrying normally concealed data is described including an outer annular member, an indicia carrying member, and an inner annular member. The outer annular member defines an annular groove configured for the positioning of the indicia carrying member. The outer annular member is preferably made of a precious metal. The inner member is preferably made of a plastic and is permanently molded in the annular groove to secure the indicia in position. While Boyd does define a ring formed of two sections, the sections are not configured for being flexibly combined for ornamental design considerations, but solely for being concealing and protecting the indicia.

A continuing need exists for a ring fabricated from at least two molds that can be flexibly interchanged and be advantageously matched to enhance variations in the ring's ornamental design.

SUMMARY

A ring described including two sections and employing two waxes, one for the interior of the ring and the other wax for the exterior. The exterior wax can have the usual designs found on the exterior of rings, such as geometrics, flowers etc, while the interior has letters, numerals or other designs that go entirely through the inner wax. The waxes can be cast separately of different metals and formed together or cast together with a single metal so that the inner surface of the outer ring shows through the openings in the inner ring.

The invention, together with attendant advantages, will be best understood by reference to the following detailed description of the invention when used in conjunction with the figures below.

FIG. 4 shows a section on lines 4—4 of FIG. 1. FIG. 5 shows a cross section of 5—5 of FIG. 4.

BRIEF DESCRIPTION OF THE DRAWINGS

Preferred embodiments of the presently disclosed multiple configuration ring arrangement is described herein with reference to the drawings, wherein.

DETAILED DESCRIPTION OF THE EMBODIMENTS

Figure 1:
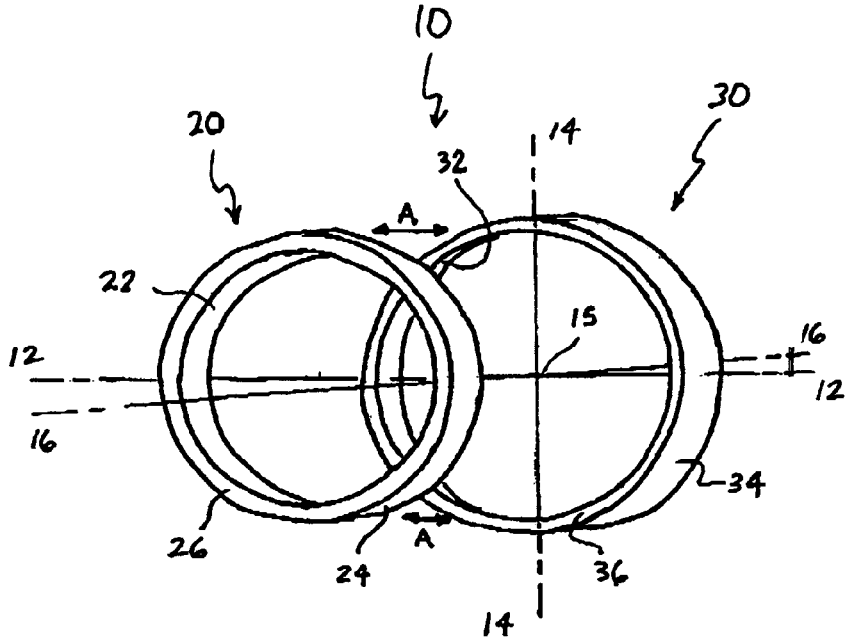
FIG. 1 is a perspective view showing a separate inner band and a separate outer band of a multiple configuration ring constructed in accordance with the present invention.
Figure 2:
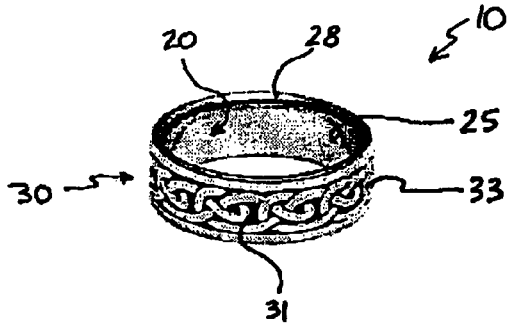
FIG. 2 is a perspective view of a second embodiment of the multiple configuration ring of FIG. 1 shown with the inner and outer sections put together.
Figure 3:
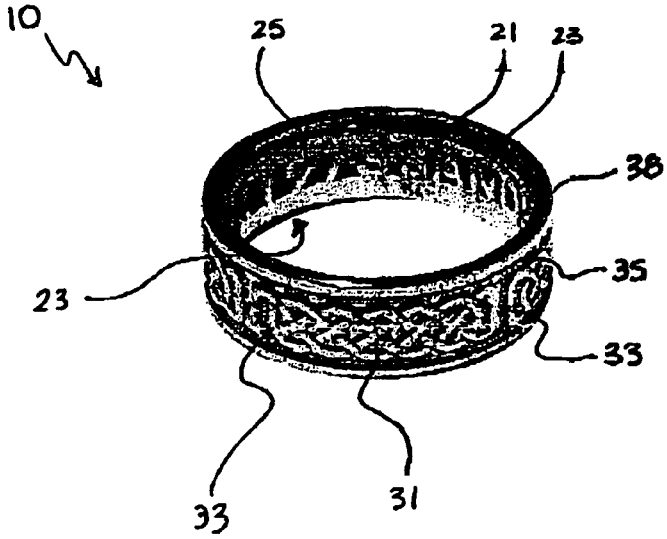
FIG. 3 is a perspective of the multiple configuration ring of FIG. 1 constructed in accordance with the present disclosure showing the inner ring in more detail.
Figure 4:
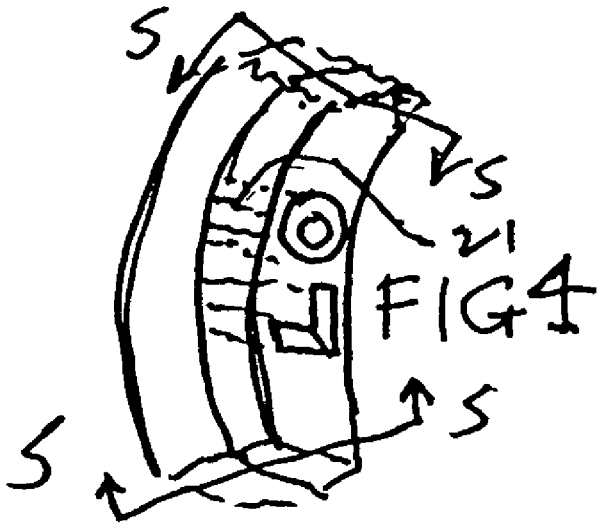
FIG. 4 shows a section on line 4—4 of FIG. 1

Referring now in specific detail to the drawings in which like referenced numerals identify similar or identical elements throughout the several views, and initially to FIGS. 1–2, a novel multiple configuration ring arrangement 10 is shown including at least two portions being fabricated by two separate molds. In one preferred embodiment, ring 10 includes a first portion or inner band 20 and a second portion or outer band 30. Ring 10 defines a first axis 12 across the diameter of ring 10 and a second axis 14 perpendicular to the first axis. First axis 12 and second axis 14 intersect at a center 15 of ring 10. A third axis 16 intersects center 15 and is perpendicular to axes 12 and 14.

First portion 20 is configured as an inner band with an inner surface 22, an outer surface 24, a first edge 26, or a second edge 28. First band 20 can include holes through 21 at least partially defining an ornamental design portion 23 such as but not limited to molded geometric, alphabetic, numeric, animal, or other shapes. First portion 20 additionally includes a solid section positioned between the through holes of ornamental design portion 23. First portion 20 can be configured with ornamental portion 23 positioned on inner surface 22 against the wearer's finger or toe, for example, or on outer surface 24. First portion 20 is fabricated from a first wax model that in turn was fabricated from a master rubber mold in the standard manner of lost wax casting.

Second portion 30 is configured as an outer band and has an inner surface 32, an outer surface 36, and a second edge 38. Second band 30 can include filigree or ornamental work 31 at least partially defining, for example, molded geometric, alphabetic, numeric or other naturally occurring shaped ornamental designs. Second portion 30 can be configured as described above and can include variations in the positioning of ornamental surface 33, have no solid banded portion 35, two ornamental portions 33 in juxtaposition with a solid banded portion 35 on one end, or a solid outer band 30 without an ornamental portion 33 and with or without engraving. Second portion 30 is fabricated using a second wax model which in turn was fabricated from a master rubber model in the standard manner of lost wax casting of rings.

The first model and the second model are configured as mating pairs for welding or otherwise fastening together. Inner band 20 and outer band 30 can be fabricated as ring 10 using the first and second models made by wax casting of different materials engagingly positioned together to form ring 10 when first portion 20 and second portion 30 are assembled after molding, outer surface 24 of the first portion 20 is configured to be inserted into inner surface 32 of second portion 30 so that they are an extremely close fit. First portion 20 and second portion 30 are subsequently connected together using typical means for the jewelry industry such as soldering, welding, or for example, by a snap or pressure fitting. The connection of separate band 20 with band 30 is preferably in the vicinity of edges 26 and 36 as well as 28 and 38, but it can be at any point of contact between the band 20 and 30. The two bands 20 and 30 can also be held together frictionally: The molded inner band 20 and outer band 30 can be fabricated of the same or different materials. This differentiation of materials can add dramatically to the appearance of ornamental portions 23 or 33. Outer surface 24 of band 20 would be slightly larger than the inner surface 32 of band 30. They could than be force fit together or band 30 can be heated to expand and band 20 cooled to contract and than placed together and left to equalize in temperature. Band 20 will expand and band 30 will contract so the two are held firmly together The bands can be made of different precious metals to give different effects. For example ornamental portion 23 at least partially defined by through holes 21 can be made of silver. Positioned radially inwardly of ornamental portion 23 is gold solid banded portion banded portion 35 providing an eye pleasing contrast between the precious metals.

By fabricating ring 10 at least two separately molded portions using individual wax models for a given size ring 10, for example, it is envisioned that first portions 20 and second portions 30 are not simply a unique mated pair, but first portions 20 and second portions 30 are suitably configured for mixing and matching between designated pairs of the same size to provide a large variety of configurations of ornamental designs 23 and/or 33. This can advantageously offer a broad appeal to a spectrum of jewelry wearers at a reduced cost.

Figure 5:
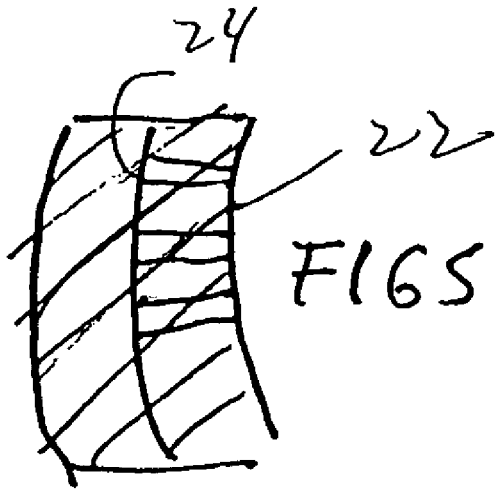
FIG. 5 shows a section on line 5—5 of FIG. 4.

Selectively choosing as an example one preferred embodiment of ring 10, wherein molded ornamental design 23 is at least partially defined by through holes 21 and provides a unique accented appearance having three dimensional depth when solid second portion 30 has a solid surface. This combination can have a varied spatial arrangement with the holes 21 extending through from surface 22 to 24 as shown in FIG. 5. The inner surface of the second portion 32 will show through the openings 21 or the first portion, so that if the first portion is made of silver and the second portion of gold the design will appear to be gold surrounded by silver. The indica in the second portion, such as letters will be openings framed in silver with the gold showing through in the centers of the letters. Alternately, the first portion and the second portion can be cast of separate waxes and than the two waxes formed together so that the ring is cast of one material such as gold, platinum or silver. When the ring is made in this manner the holes 21 in the first portion will extend through the first portion to the inner surface of the second portion. The lettering, numbering or other indica in the first portion will appear to be like very deep engraving in the inside of the ring when there is no engraving.

In addition, in the above preferred embodiments as a result of the use of different metals, outer surface 34 of area 33, and inner surface 22 can have similar or contrasting surface treatments, plating, or other process providing an altered visual appearance such as coatings that can have advantageous and viewer appeal. The use of different metals alone or in combination with the above variations can also heighten the sensation of depth of the holes 21 in the first portion.

The preceding fabrication process has been described using the lost wax process and it is understood that processes evolve over time and new processes are invented accommodating improved capabilities. Thus, the lost wax process described herein is considered to be a broadly representative example of different fabrication processes utilized in the jewelry industry suitable for creating fine jewelry. It is the intent of this disclosure to encompass all of the above processes as they relate to the fabrication of a ring having at least two portions. A jewelry ring has been described but it is understood that this invention may be applied equally as well to other jewelry.

Thus the combination of the first portion 20 and second portion 30 provides multiple configurations of ring 10 as a result of the separate wax models for at least first portion 20 and second portion 30 that can be molded separately or together to form the ring assembly 20. In one preferred embodiment the multiple configurations are achieved solely by using different metals or the same metal for the molding of first portion 20 and second portion 30. Preferably this preferred embodiment produces a ring 10 having an ornamental design 23 at least partially defined by through holes 21 that are subsequently blocked by solid banded portions 35. A ring can be cast to have deeply cast numbers, letters or designs in the inner surface to give a distinctive appearance.

Differing configurations are also achieved by rearranging the positions of ornamental portions 23 relative to solid banded portions 35 of a given first portion 20 and second portion 30. Further multiple configurations can be achieved by mixing and matching between different pairs of first portions 20 and second portions 30 having differing ornamental designs 23 and/or 33 of other rings 10.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

The invention claimed is:

1. A ring comprising:

a first band portion having an inner surface, an outer surface and a first edge;

a second band portion having an inner surface, an outer surface and a second edge, the second band portion being completely solid, and the first edge residing on the same plane as the second edge; and a plurality of unobstructed openings cast in said first band portion extending from the inner surface to the outer surface, wherein the bands are engagingly positioned to fit one band completely within the other, and whereby said second band is clearly seen through the unobstructed openings.

2. The ring of claim 1 whereby said unobstructed openings form indica or geometric designs.

3. The ring of claim 1 whereby the second band portion has an outer surface which is substantially the same diameter as the inner surface of the first band portion.

4. The ring of claim 3 whereby the second band portion fits inside the first band portion to to form a single ring.

5. The ring of claim 4 whereby the outer surface of the second band portion forms the back surface of the unobstructed openings in the first band portion.

6. The ring of claim 5 whereby said unobstructed openings form indica or geometric designs.

7. The ring of claim 1 whereby the first band portion and the second band portion are of different precious metals and are cast separately and fitted together.

8. The ring of claim 7 wherein the first and second band portions are cast from wax by the lost wax process.

9. The ring of claim 1 whereby the first band portion has an outer surface which is substantially the same diameter as the inner surface of the second band portion.

10. The ring of claim 9 whereby the first band portion fits inside the second band portion to form a single ring.

11. The ring of claim 10 whereby the inner surface of the second band portion forms the back surface of the unobstructed openings of the first band portion.

12. The ring of claim 11 wherein the first and second band portions are cast from wax by the lost wax process.

13. The ring of claim 12 whereby said unobstructed openings form indica or geometric designs.

* * * * *